United States Patent [19]

Pemberton

[11] 4,015,891

[45] Apr. 5, 1977

[54] ELECTRICAL CONNECTOR

[75] Inventor: Donald Stuart Pemberton, Stoke-on-Trent, England

[73] Assignee: Rist's Wires & Cables Limited, Birmingham, England

[22] Filed: Apr. 22, 1975

[21] Appl. No.: 571,015

[30] Foreign Application Priority Data

May 1, 1974 United Kingdom ..... 19081/74

[52] U.S. Cl. ..... 339/217 S

[51] Int. Cl.[2] ..... H01R 13/40

[58] Field of Search ..... 339/217 R, 217 S

[56] References Cited

UNITED STATES PATENTS

| | | | |
|---|---|---|---|
| 2,509,192 | 5/1950 | Poupitch | 85/11 |
| 2,943,293 | 6/1960 | Bucher et al. | 339/276 T |
| 3,142,527 | 7/1964 | Eggman | 339/217 S |
| 3,173,736 | 3/1965 | Brinkel et al. | 339/217 S |
| 3,465,279 | 9/1969 | Krehbiel | 339/176 M |

*Primary Examiner*—Joseph H. McGlynn
*Attorney, Agent, or Firm*—Holman & Stern

[57] ABSTRACT

An electrical connector comprising an elongate, electrically conducting body having one end adapted to be connected with a bared end of an electrical lead and its opposite end adapted to be engaged with another electrical connector, and at least one lance extending from the body intermediate the ends thereof for opposing disengagement of the electrical connector from a recess in a housin g for the connector, the or each lance having an edge at a free end thereof which is angled relative to the body so that one end of said edge of the lance lies further away from a longitudinal axis of the body and nearer to said opposite end of the body than an opposite end of said edge of the lance.

7 Claims, 6 Drawing Figures

ELECTRICAL CONNECTOR

This invention relates to an electrical connector of a type which is designed to be lodged in a recess in a housing for the connector, the connector having at least one lance which extends from the connector intermediate the ends thereof and serves to oppose disengagement of the electrical connector from the recess.

It has previously been the practice to form the or each lance by making cuts in a portion of the body which define three sides of a rectangle and then bending the material separated from the rest of the connector by the three cuts radially away from the longitudinal axis of the connector to define the lance. When the electrical connector is engaged in the recess in the housing, the lance is deflected inwardly by a shoulder in the recess and then springs back to engage behind the shoulder to prevent withdrawal of the connector from the recess. However, it is a disadvantage of the above-described connector that, upon assembly, it appears to be correctly seated in the recess with the lance engaging behind the shoulder when, in fact, it may not be fully engaged. In such cases, the electrical connector can come fully disengaged relatively easily in use.

It is an object of the present invention to obviate or mitigate the above disadvantage.

According to the present invention, there is provided an electrical connector comprising an elongate, electrically conducting body having one end adapted to be connected with a bared end of an electrical lead and its opposite end adapted to be engaged with another electrical connector, and at least one lance extending from the body intermediate the ends thereof for opposing disengagement of the electrical connector from recess in a housing for the connector, the or each lance having an edge at a free end thereof which is angled relative to the body so that one end of said edge of the lance lies further away from a longitudinal axis of the body and nearer to said opposite end of the body than an opposite end of said edge of the lance.

Preferably, the or each lance is formed integrally with the body by cutting and bending part of said body.

Advantageously, said edge of the lance is formed by a transverse cut in the body which is angled relative to a normal to said longitudinal axis.

Side edges of the or each lance are preferably defined by cuts extending longitudinally of the body from the transverse cut towards said opposite end of the body, one of said longitudinally extending cuts being longer than the other.

Figure 1:
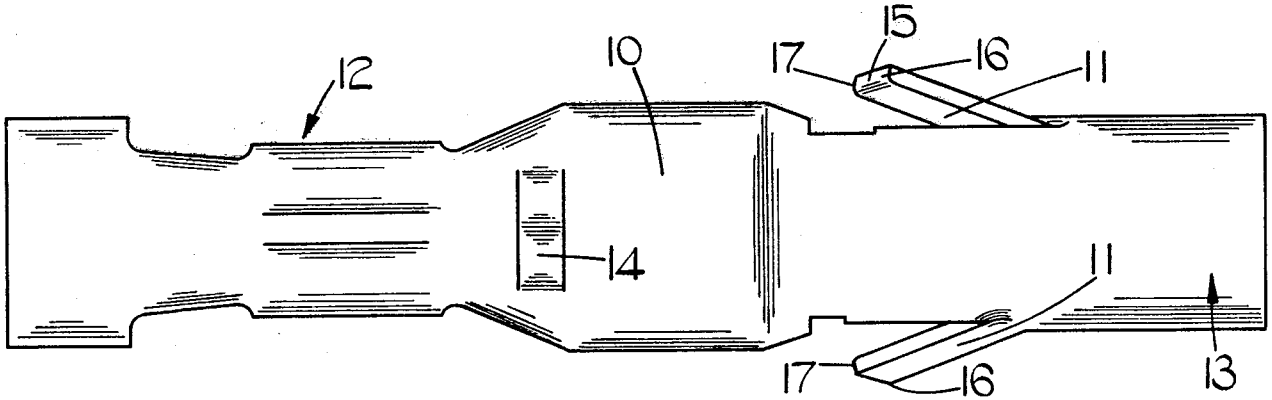
Figure 2:
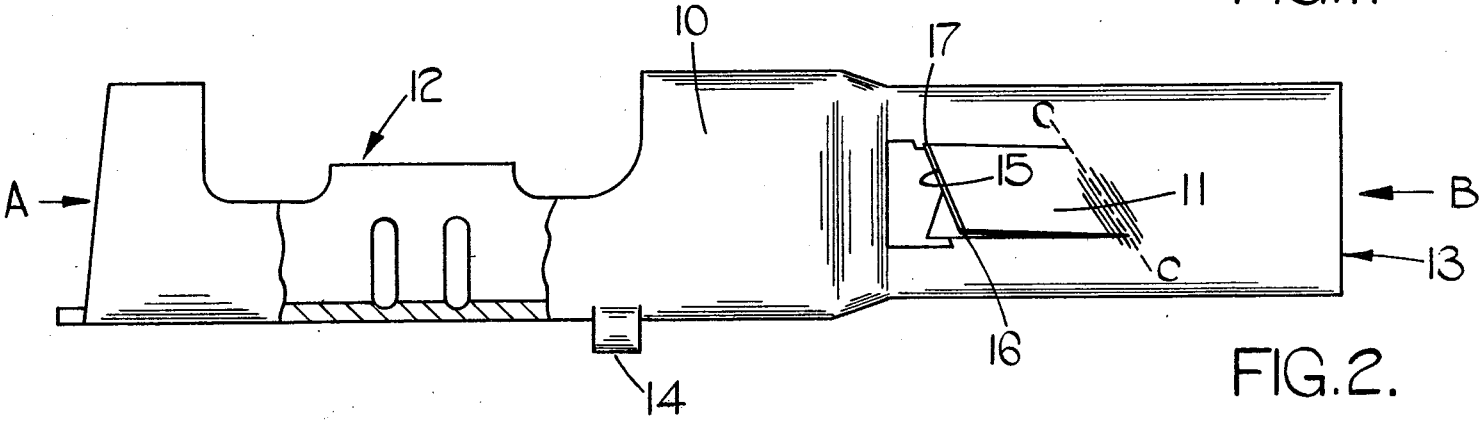
Figure 6:
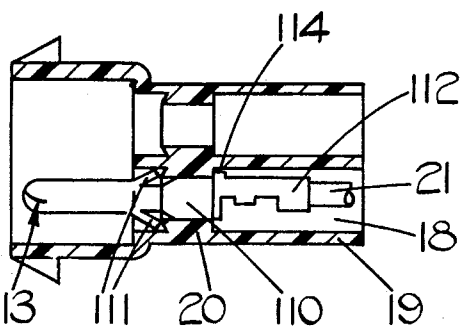
Figure 4:
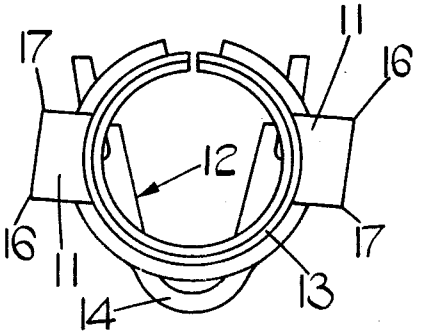
Figure 3:
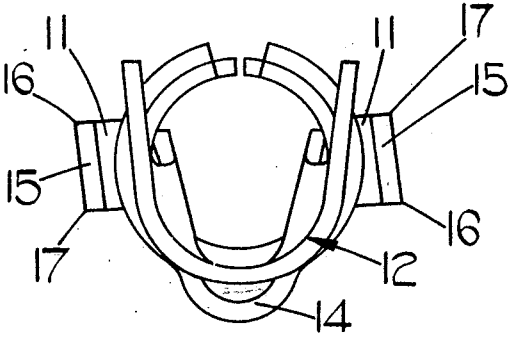
Figure 5:
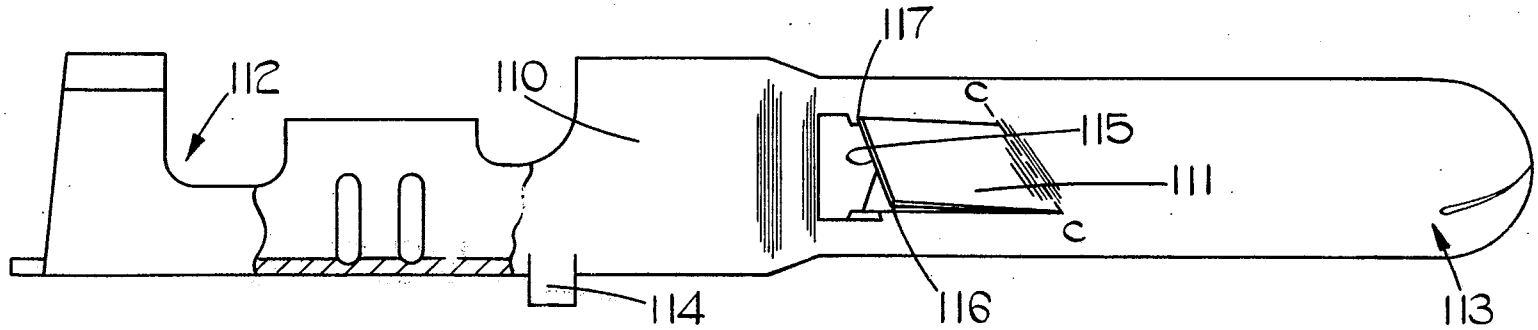

Embodiments of the present invention will now be described, by way of example, with reference to the accompanying drawings, in which:

FIG. 1 is a plan view of an electrical socket connector according to the present invention, FIG. 2 is a part sectional elevation of the electrical socket connector of FIG. 1, FIG. 3 is an end view in the direction of arrow A of the socket connector of FIG. 2, FIG. 4 is an end view in the direction of arrow B of the socket connector of FIG. 2, FIG. 5 is a part sectional side elevation of an electrical pin connector also according to the present invention, and FIG. 6 is a longitudinal sectional view, on a smaller scale, of a housing in which is fitted the pin connector of FIG. 5.

Referring to FIGS. 1 to 4 of the drawings, the electrical socket connector comprises a body 10 formed by a cutting and bending operation on a brass sheet, and a pair of opposed lances 11 which are integral with the body 10 and extend therefrom intermediate the ends of the body 10. One end 12 of the body is formed in a manner well known per se to enable it to be connected to a bared end of an electrical lead (not shown) by a crimping operation. Since the shape of the end 12 of the electrical connector is well known and forms no part of the present invention, it will be described in no further detail. The opposite end 13 of the body 10 is open and is of circular cross-section to receive another electrical connector in the form of the pin connector of FIG. 5. Between the lances 11 and the said one end 12, the body 10 is provided with an abutment 14 which is formed by an integral loop extending from the body 10. The purpose of the abutment 14 will be described hereinafter.

Each lance 11 is formed integrally with the body 10 during manufacture of the latter by forming a (i) a cut extending transversely of the body 10, the cut being angled relative to a normal to a longitudinal axis of the body 10, and (ii) a pair of parallel cuts extending from the transverse cut longitudinally of the body 10 towards said opposite end 13 of the body 10. The longitudinally extending cut which is lowermost as viewed in FIG. 2, is longer than the upper longitudinal cut so that when the lance 11 is bent outwardly of the body 10, bending occurs along dotted line C—C (see FIG. 2). Because of the angled transverse cut and because of the bending operation on line C—C, an edge 15 at the free end of the lance is angled relative to the body 10 so that one end 16 of the edge 15 lies further away from the longitudinal axis of the body 10 and also nearer to the opposite end 13 of the body 10 than an opposite end 17 of the edge 15. As can be seen from FIGS. 3 and 4, the edges 15 of the lances 11 are substantially parallel so that the end 16 of the right hand lance 11 as viewed in FIG. 3 is below the opposite end 17 of the same lance 11, whilst the relative positions of the ends 16 and 17 of the left hand lance as viewed in FIG. 3 are reversed.

Referring now to FIG. 5, the pin connector illustrated therein is similar to the socket connector of FIGS. 1 to 4 and similar parts are accorded the same reference numeral, prefixed by 1. The only differences between the two connectors is that end 113 is closed, has an external diameter of a size to be an interference fit within end 13 of the socket connector, and is also extended further away from lances 111 than is end 13 from its respective lances 11.

Referring now to FIG. 6, the pin connector of FIG. 5 and the socket connector of FIGS. 1 to 4, are engaged in an indentical manner in recesses 18 in an electrically insulating housing 19. The location of the electrical connector in the recess 18 will be described with reference to the pin connector of FIG. 5. The recess 18 in the housing 19 is provided with an internal, annular shoulder for engagement between lances 111 and with abutment 114. Before engagement of the pin connector in recess 18, the bared end of an electrical lead 21 is secured to the body 10 by effecting a crimping operation on end 112. Then, end 113 is inserted into the recess 18 at the right hand side of the housing 19 as viewed in FIG. 6. As the body 110 passes into recess 18, the lances 111 are deflected inwardly by the shoulder 20 until end 116 on each lance 11 has passed beyond shoulder 20. When this has occurred, each lance 11 is partially freed so that it can spring outwardly relative to the body to lodge behind shoulder 20 because of the angling of edge 115 and the positioning of end 116 relative to end 117, there is an inherent tendency for the lances 11 to draw the body 10 further into the recess 18. Whilst this is happening, abutment 114 comes into engagement with the opposite end of shoulder 20 so that the shoulder 20 is trapped firmly between lances 111 and abutment 114 whereby the body 110 is held firmly in the desired position within recess 18. When the body 110 is positioned correctly, both lances 111 have passed fully beyond shoulder 20 and sprung outwardly so that the ends 117 of edge 115 dig into the adjacent end of shoulder 20 to prevent accidental withdrawal of the body 110 from recess 18.

I claim:

1. An electrical connector comprising an elongate, electrically conducting body, one end of said body being formed to be connected with a bared end of an electrical lead, an opposite end of said body being formed to be engaged with another electrical connector, and at least one lance longitudinally extending from said body intermediate said ends thereof for opposing disengagement of the electrical connector from a recess in a housing for the connector, said lance having an edge at a free and thereof said edge extending across said lance which is angled relative to said body forming a point for digging into said housing so that one end of said edge of said lance lies further away from a longitudinal axis of said body and nearer to said opposite end of said body than an opposite end of said edge of said lance.

2. The electrical connector according to claim 1, wherein said lance is formed integrally with said body by cutting and bending part of said body.

3. The electrical connector according to claim 1, wherein said lance is joined to said body on a line which is non-perpendicularly disposed relative to a longitudinal axis of said body.

4. The electrical connector according to claim 1, wherein said lance is planar.

5. The electrical connector according to claim 1, wherein said edge of said lance is formed by a cut extending transversely of said body, said cut being angled relative to a normal to said longitudinal axis.

6. The electrical connector according to claim 5, wherein side edges of said lance are defined by cuts extending longitudinally of said body from said transversely extending cut towards said opposite end of said body, one of said longitudinally extending cuts being longer than the other.

7. An electrical connector comprising an electrically conducting body, one end of said body being formed to be connected with an electrical lead, an opposite end of said body being formed to be engaged with another electrical connector, and at least one lance longitudinally extending from said body intermediate said ends for opposing disengagement of the electrical connector from a recess in a housing for the connector, said lance being integrally joined to said body on the line which is non-perpendicularly disposed relative to a longitudinal axis of said body, wherein said lance includes an edge at a free end thereof, said edge of said lance is formed by a cut extending transversely of said body, said cut being angled relative to a normal to said longitudinal axis.

* * * * *